United States Patent [19]

Palmer

[11] Patent Number: 4,807,430

[45] Date of Patent: Feb. 28, 1989

[54] THREAD WRAPPING APPARATUS

[75] Inventor: David W. Palmer, Charlotte, N.C.

[73] Assignee: Walker Magnetics Group, Inc., Worcester, Mass.

[21] Appl. No.: 112,498

[22] Filed: Oct. 22, 1987

[51] Int. Cl.[4] ..... D02G 3/34; D02G 3/38; D01H 1/32; D01H 7/88

[52] U.S. Cl. ..... 57/18; 57/16; 57/17; 57/19; 57/100

[58] Field of Search ..... 57/16–19, 57/100, 105, 264

[56] References Cited

U.S. PATENT DOCUMENTS 3,928,957 12/1975 Petrov et al. ..... 57/18

4,117,654 10/1978 Petrov et al. ..... 57/19

4,455,817 6/1984 Mehta ..... 57/100 X 4,470,248 9/1984 Nortenius ..... 57/19 X

*Primary Examiner*—John Petrakes

*Attorney, Agent, or Firm*—Henry D. Pahl, Jr.

[57] ABSTRACT

In the thread wrapping apparatus disclosed herein a binder spindle is driven by control circuit at a speed corresponding to the operating frequency of a variable oscillator. First, second and third sets of drafting rolls which draw and feed a sliver of fibers to the binder spindle are driven by respective stepper motors through control circuits which operate each of the motors at a respective speed which is an individually preselectable proportion of the speed of the spindle.

6 Claims, 4 Drawing Sheets

THREAD WRAPPING APPARATUS

BACKGROUND OF THE INVENTION

The present invention relates to apparatus for forming a wrapped thread from a fiber supply, the process being commonly referred to as wrap spinning, and more particularly to such apparatus in which the speeds of drafting rolls feeding a binder spindle are electronically controlled to maintain respective speeds which are individually preselectable proportions of the speed of the spindle.

In the wrap spinning of yarn, fibers are drawn or "drafted" from a supply of the fibrous material by a succession of drafting rolls. The successive rolls are run at increasing speed so as to draw out the fibers to an appropriate weight. From the drafting rolls the fibers are fed through a spindle which contains a supply of a filament binder. The binder spindle, operating at a relatively high rotational speed, wraps the binder filament around the fiber sliver thereby completing the yarn. As is well understood by those skilled in the art, the characteristics of the finished yarn are affected by the relative speeds of the successive drafting rolls and also by the relative speed of the binder spindle.

In conventional wrap spinning apparatus, it is common for a large number of wrap spinning stations to be driven from a common motive source, usually a large, variable speed electric motor. The speed differential between successive drafting rolls is established either by gearing between the shafts driving the successive roll stages or by providing different motors which are manually adjusted to appropriate speeds. All binder spindles are typically driven through a tangential belt drive from a variable speed motor, speed of such motor being operator selectable.

In the event of a malfunction at one wrap spinning station, i.e., due to a yarn break or the need to refill a binder spindle, all of the commonly powered stations must be stopped to service the malfunctioning station. Further, the restarting procedure is difficult to achieve without inducing further breaks or a deviation in the characteristics of the yarn since it is difficult to bring all speeds up to the desired final operating speeds while maintaining the desired speed relationships.

Among the several objects of the present invention may be noted the provision of apparatus for forming a wrap thread from fibers in which the speeds of successive drafting rolls are electronically controlled through respective roll motors to operate at respective speeds which are individually preselectable proportions of the speed of the binder spindle; the provision of such apparatus in which the speed of the spindle is electronically controlled to a speed corresponding to the operating frequency of a variable oscillator; the provision of such apparatus which facilitates the independent operation of a plurality of wrap spinning stations; the provision of such apparatus which facilitates the restarting of a wrap spinning station following the break of a thread or the restocking of supply materials; the provision of such apparatus which is highly reliable and which is of relatively simple and inexpensive construction. Other objects and features will be in part apparent and in part pointed out hereinafter.

SUMMARY OF THE INVENTION

Apparatus according to the present invention operates to form a wrapped thread from a fiber supply. The thread is wrapped with binder material by a binder spindle which is driven, by a spindle motor, at a preselectable speed determined by a control circuit, the spindle motor being operated at a speed corresponding to the operating frequency of a variable oscillator within the control circuitry. First, second and third sets of rolls are provided for drawing the sliver and feeding it to the binder spindle, a respective roll motor being provided for each set of rolls. Respective control circuits are employed for operating each of the roll motors at a respective speed which is an individually preselectable proportion of the speed of the spindle.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
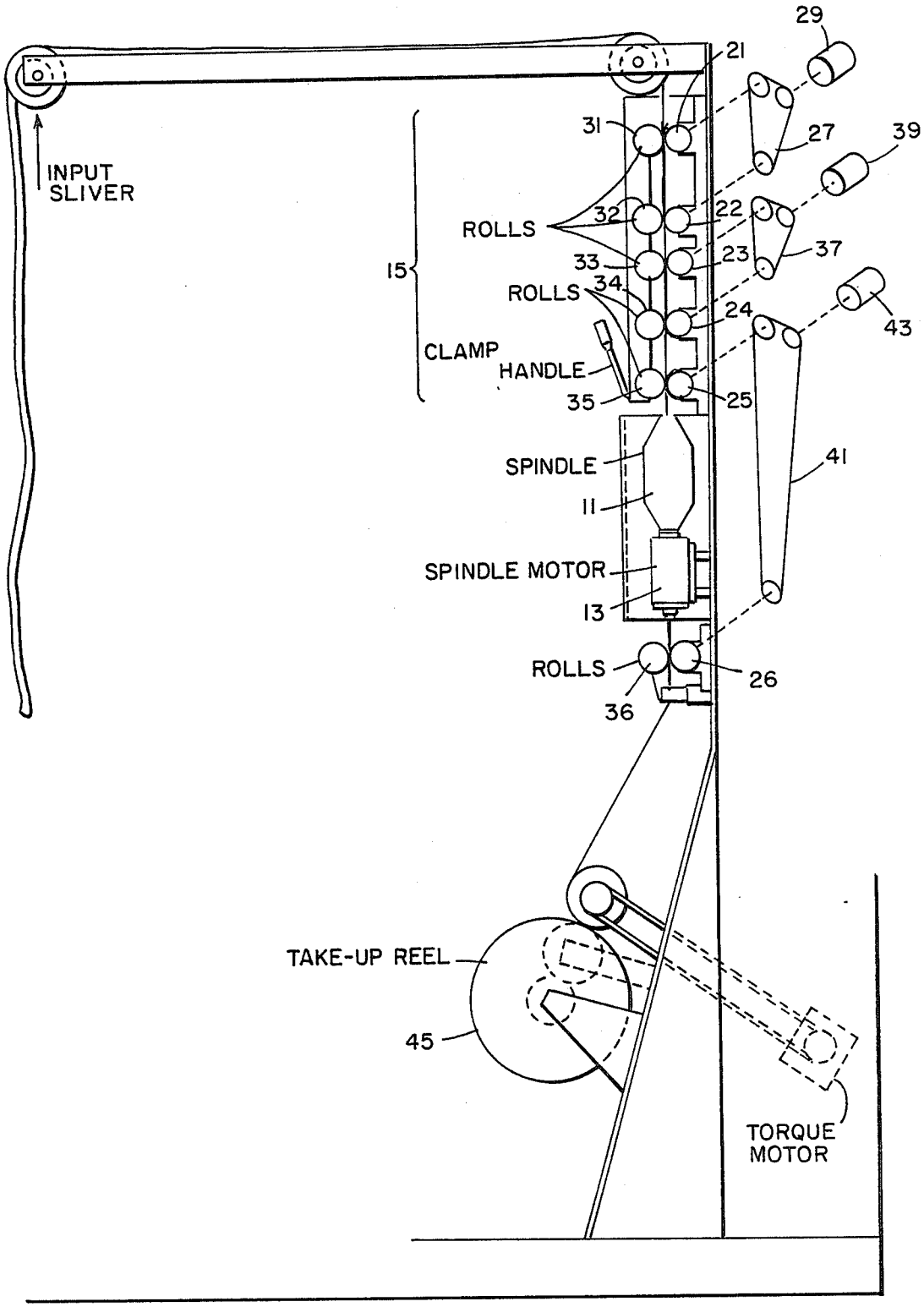
FIG. 1 is a diagrammatic side view of wrap spinning apparatus constructed in accordance with the present invention.

Referring now to FIG. 1, the binder spindle which wraps a filament binder on a fiber supply is indicated generally by reference character 11. As is conventional, the binder spindle carries a supply of the filament binder material and the fiber to be wrapped passes through the spindle as well as through the hollow shaft of a variable speed induction motor 13 which drives the spindle.

A drafting roll assembly is indicated generally by reference character 15. The drafting roll assembly comprises five pairs of rolls arranged in three sets, each set operating at a respective preselectable speed as described hereinafter. The right hand five rolls are designated 21 through 25 and left hand rolls are designated 31 through 35. The five rolls to the right are driven and are mounted in a fixed frame while the five rolls to the left are allowed to free wheel and are mounted in a movable clamping frame. The left five rolls can thus be moved out of engagement with the driven rolls, i.e. for feeding a new input sliver, and then brought back into clamping engagement with their corresponding driven rolls to effect drafting of the fiber.

As indicated diagrammatically in FIG. 1, the driving shafts for rolls 21 and 22 are linked by a timing belt 27 so that they rotate at the same speed and they are driven by a stepper motor 29. Similarly, the driving shafts for the rolls 23 and 24 are linked by a timing belt 37 and are driven by a stepper motor 39. The driving shaft for the last of the drafting rolls, i.e. the roll 25, is linked by timing belt 41 to the driving shaft of the output roll 26 and this set of rolls is driven by a stepper motor 43. The completed wrapped yarn is gathered up by a take-up reel 45 which is driven by a torque motor (not shown) so as to maintain a suitable tension on the yarn.

Figure 2:
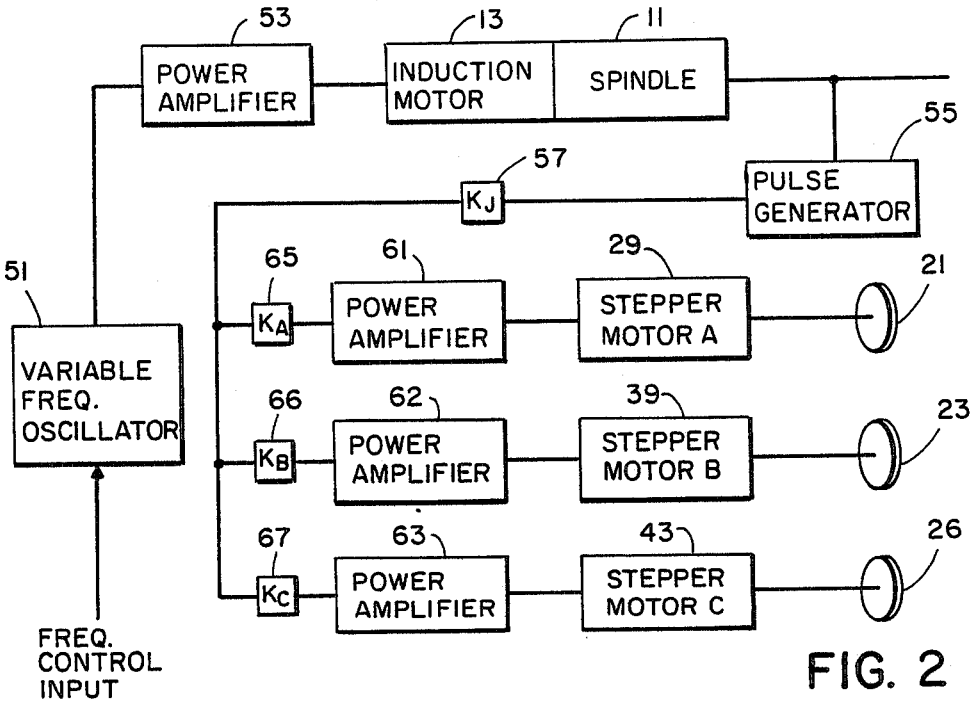
FIG. 2 is a block diagram of control circuitry employed in operating various motors employed in the apparatus of FIG. 1.

Referring now to FIG. 2, a variable frequency oscillator is indicated generally by reference character 51. The operating frequency of oscillator 51 is an operator selectable parameter and, in the particular embodiment illustrated, constitutes a single control parameter for varying the speed of the binder spindle and all drafting rolls simultaneously. As will be understood by those skilled in the art, this availability of a single control for all speeds along the path of a given fiber supply greatly facilitates start up procedures following shut down of a particular station. The output signal from the variable frequency oscillator is supplied to a power amplifier 53 which drives the induction motor 13 at a speed corresponding to the operating frequency of the oscillator 51.

A tachometer pulse generator 55 is provided for generating a pulsatile signal at a frequency corresponding to the rotational speed of the induction motor 13 and spindle 11. An optical interruptor module is preferred for this function but it should be understood that magnetic sensors might also be used. Similarly, while one pulse per revolution has been found to be entirely adequate, a higher number of pulses might also be utilized if it were desired to provide a finer degree of resolution in the adjustability of the speed of the drafting rolls, this adjustability being obtained as described hereinafter. The output signal from the tachometer pulse generator 55 is applied to a prescaler 57 which scales the pulse rate to a value appropriate for facilitating the subsequent control circuitry.

Each of the stepper motors 29, 39 and 43 is provided with a respective stepper driver circuit 61–63. The stepper driver circuits generate the necessary phased signals for application to the various windings of the stepper motors in conventional fashion in response to a control signal, usually designated the step signal, which is provided to the driver circuitry.

The step signals for controlling the driver circuits 61–63 are generated by respective pulse rate scalers 65–67 which are in turn driven by the signal from the tachometer pulse generator as adjusted in rate by the prescaler 57. While the prescaler 57 and the pulse rate scalers 65–67 may, in the embodiment illustrated, be constituted by simple digital counters or dividers, it should be understood that a variety of pulse rate scaling or frequency synthesis techniques are known in the electronics art and might also be utilized, depending upon the characteristics of the various components most economically available for assembling the system of the present invention. Similarly, while the particular embodiment illustrated contemplates fixed scaling ratios for any given installation, it should be understood that, by incorporating latches or memories int the divider or scaler circuitry, the frequency division ratios might be changed on the fly under operator or programmatic control.

In operation, it can be seen that a given wrap spinning station can be loaded with a fiber and a supply of filament binder material and then easily brought up to operating speed merely by progressively advancing the frequency of operation of the oscillator 51 since the speed of each pair of the drafting rolls will be scaled to the speed of the spindle 11, the actual rate of speed of each of the rolls being individually preselectable by means of the scaling values provided by the respective pulse rate scaler circuits 65–67.

As is understood by those skilled in the art, stepper motors of the type used to drive the drafting rolls in the FIG. 2 embodiment inherently tend to lock or synchronize with the driving signals so that effectively synchronous or phase locked operation is obtained, as long as certain rate and rate change limitations are not exceeded. Thus, the use of stepper motors is presently preferred. On the other hand, it should also be understood that closed loop feedback control might also be employed to cause the speeds of the drafting rolls to follow the speed of operation of the binder spindle. Such an embodiment is illustrated in FIG. 3.

Figure 3:
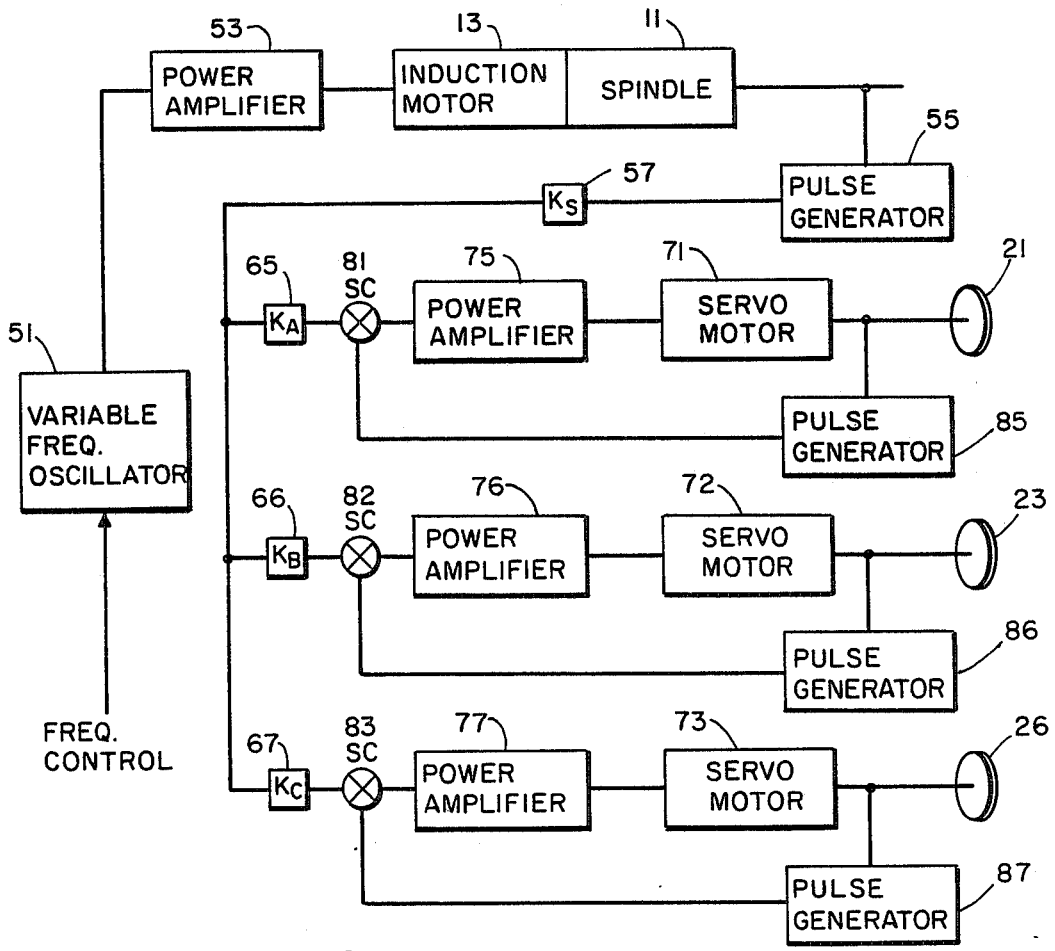
FIGS. 3 and 4 are block diagrams of alternate control circuitry for controlling the motors in the FIG. 1 apparatus.

With reference to FIG. 3, it can be seen that the drafting rolls 21, 23 and 26 are driven by servo motors 71–73 rather than the stepper motors of the embodiment of FIG. 2. Each of the servo motors 71–73 is provided with a respective power amplifier 75–77, the power amplifiers in turn being controlled from respective phase comparator circuits 81–83. In this embodiment the output shaft of each of the servo motors is provided with a respective tachometer pulse generator 85–87, the output of each pulse generator being applied as one input to the respective phase comparator 81–83. The other input to each phase comparator is the pulsatile output signal from the respective pulse rate scaler 65–67. As will be understood by those skilled in the control art, this arrangement will provide closed loop positional control of the drive shafts for the successive drafting rolls, the speed of each roll being thereby controlled as a respective preselected proportion of the operating speed of the spindle as measured by the tachometer pulse generator 55.

Figure 4:
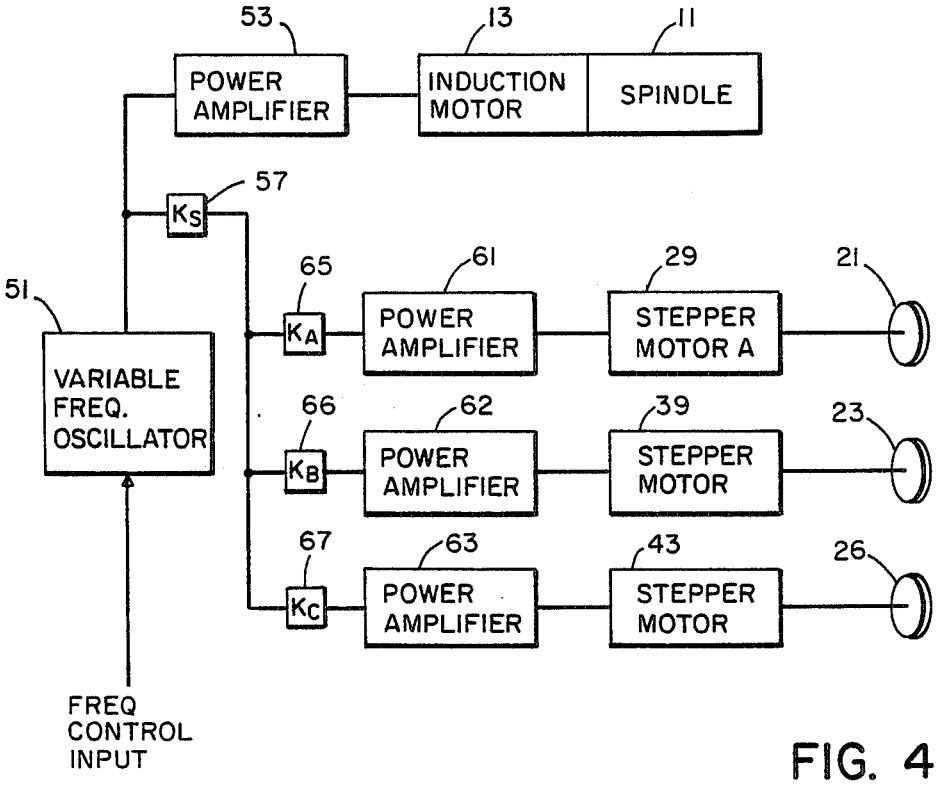

Similarly, while it is currently preferred to utilize a tachometer pulse generator to directly measure the speed of the spindle thereby to precisely control speeds of the various drafting rolls, it should be understood that the output signal from the variable frequency oscillator 51 is, in fact, a quite good representation or indication of this speed, since it is this parameter which controls or varies spindle speed. Thus, rather than using a separate pulse generator, it should be understood that both the speeds of the drafting rolls and the speed of the binder spindle could be slaved directly to the variable oscillator. Such a system, otherwise similar to the open loop stepper motor version of FIG. 2, is illustrated in FIG. 4. This embodiment is similar to the FIG. 2 embodiment except that the input signal to the prescaler 57 is taken from the variable frequency oscillator 51 rather than from a tachometer pulse generator associated with the binder spindle. As will be understood, the scaling values provided by the prescaler and/or the scaler 65–67 will be adjusted or determined by the various operating frequencies required by the several components of the system. These scaling values, however, are relatively easily preselectable as is understood by those skilled in the control circuitry art.

Figure 5:
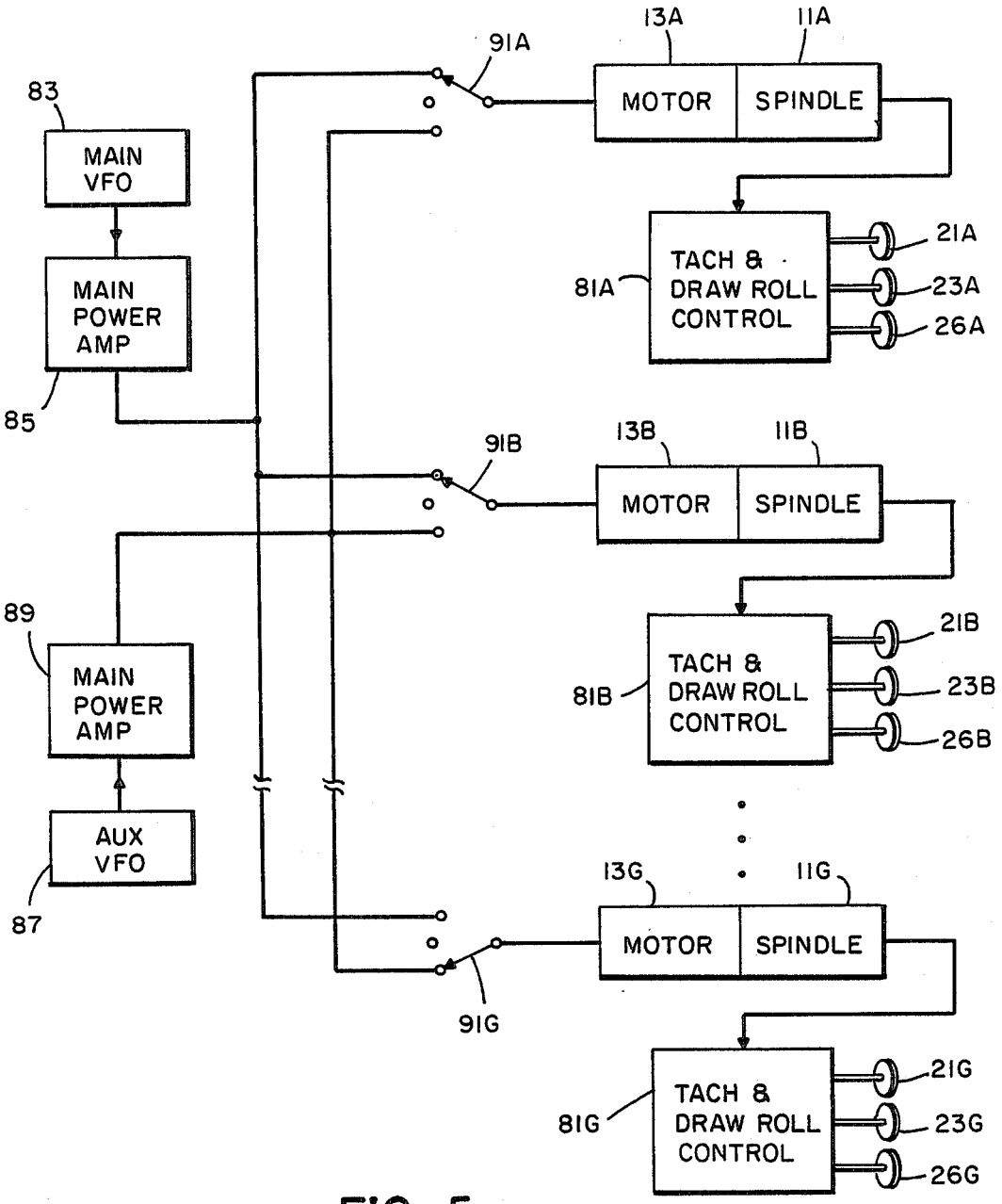
FIG. 5 is a block diagram control circuitry for controlling multiple wrap spinning stations.

In installations where a large number of stations are manufacturing the same product, it has been found advantageous to drive multiple spindles from a common oscillator/amplifier combination during steady state operations and to provide an auxiliary oscillator and power amplifier for allowing an individual station to be stopped and then be brought up to the desired speed. Such an arrangement is illustrated in FIG. 5. The overall system illustrated in FIG. 5 comprises a plurality of thread wrapping stations each having their own spindles 11A–11G and driving motors 13A–13G. Each wrapping station is also provided with stepper motors and stepper motor control circuitry, designated generally by reference characters 81A–81G, for driving the corresponding fiber drawing rolls at that station. The several stepper motor control circuitries 81A–81G may, for example, each be essentially identical to the corresponding portion of the circuit shown in FIG. 2.

A main variable frequency oscillator 83 drives a main power amplifier 85 having sufficient capacity to drive all of the spindle motors 13A–13G in the multi-station system. An auxiliary variable frequency oscillator 87 is provided which drives an auxiliary power amplifier 89 having sufficient capacity to drive one or two of the spindle motors. Each of the spindle motors 13A–13G can be connected to either the main power amplifier 85 or to the auxiliary power amplifier 89 or it can be disconnected from both by means of a suitable switch, these switches being designated by reference characters 91A–91G.

During normal running, all of the spindle motors 13A–13G will be connected to the main power amplifier 85 so that the character of the product is uniformly determined by the setting of the main variable frequency oscillator 83. However, if the thread at one station breaks, it can be disconnected from either of the power amplifiers and allowed to come to a stop. As will be understood, the speeds of the corresponding draw rolls will continue to scale to the spindle speed as it decelerates, since each station has its own control circuitry for the stepper motors which drive the draw rolls. When the station has been re-threaded, the spindle can be switched over to the auxiliary power amplifier 89 and the frequency of the auxiliary VFO 87 can be ramped up to bring the station up to a speed which matches that of the other stations. At this point, the re-started station can be switched back over to the main power amplifier 85.

At the start of the day or work shift, it is not necessary to bring the individual stations up to speed individually with the auxiliary VFO 85 but, rather, the main VFO 83 can be ramped up to speed, assuming all the stations are properly threaded and otherwise ready to go.

In view of the foregoing, it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. Apparatus for forming a wrapped thread from a fiber supply, said apparatus comprising:

a binder spindle;

a variable speed induction motor for driving said binder spindle at a preselectable speed;

a first control circuit means, including a variable oscillator and amplifier means, for operating said induction motor means at a speed corresponding to the operating frequency of said oscillator;

first, second and third sets of rolls for drawing said fiber, said third set of rolls having a pair of rolls downstream of said spindle, a stepper motor means for each of said sets of rolls for driving the respective set of rolls at a respective preselectable speed; and respective control circuit means for operating each of said stepper motor means, each of said respective control circuit means including a respective frequency scalar driven from said oscillator for operating the respective stepper motor means at a respective speed which is an individually preselectable proportion of the speed of said spindle motor.

2. Apparatus as set forth in claim 1 wherein said first control circuit means comprises a frequency scaler for generating an a.c. signal at a frequency which is a preselected proportion of the operating frequency of said oscillator, which a.c. signal is applied to said amplifier means for operating said induction motor at the frequency of said a.c. signal.

3. Apparatus for forming a wrapped thread from a fiber supply, said apparatus comprising:

a binder spindle;

a variable speed induction motor for driving said binder spindle at a preselectable speed;

a first control circuit means, including a variable oscillator, and an amplifier driven by said oscillator to provide to said induction motor alternating current at the operating frequency of said oscillator for operating said spindle motor means at a speed corresponding to the operating frequency of said oscillator;

tachometer means driven by said spindle for generating a pulsatile signal at a frequency corresponding to the operating speed of said spindle;

first, second and third sets of rolls for drawing said fiber, said third set of rolls having a pair of rolls downstream of said spindle;

a stepper motor means for each of said sets of rolls for driving the respective set of rolls at a respective preselectable speed; and respective frequency scaler circuit means, driven from said pulsatile signal, for providing to each respective stepper motor a step signal which is an individually preselectable proportion of the frequency of said pulsatile signal.

4. Apparatus as set forth in claim 3 wherein said first control circuit means includes a frequency scaler for generating an a.c. signal at a frequency which is a preselected proportion of the operating frequency of oscillator, which a.c. signal is applied is applied to said amplifier for operating said induction motor at the frequency of said a.c signal.

5. Apparatus for forming wrapped thread from a fiber supply, said apparatus comprising:

a plurality of wrapping stations each of which includes, a binder spindle, spindle motor means for driving said binder spindle at a preselectable speed, first, second and third sets of rolls for drawing said fiber, said third set of rolls having a pair of rolls downstream of said spindle, a roll motor means for each of said sets of rolls for driving the respective set of rolls at a respective preselectable speed, and respective control circuit means for operating each of said roll motor means at a respective speed which is an individually preselectable proportion of the speed of said spindle motor, said apparatus further comprising:

a first control circuit means, including a variable oscillator, for operating a plurality of said spindle motor means at a speed corresponding to the operating frequency of said oscillator;

a second control circuit means, including a second variable oscillator, for operating at least one of said spindle motor means at a speed corresponding to the operating frequency of said second oscillator; and respective switching means for connecting each of said spindle motor means to either said first control circuit means or said second control circuit means.

6. Apparatus for forming wrapped thread from a fiber supply, said apparatus comprising:

a plurality of wrapping stations each of which includes, a binder spindle, spindle motor means for driving said binder spindle at a preselectable speed, tachometer means driven by each spindle for generating a pulsatile signal at a frequency corresponding to the operating speed of the respective spindle, first, second and third sets of rolls for drawing said fiber, said third set of rolls having a pair of rolls downstream of said spindle, a stepper motor means for each of said sets of rolls for driving the respective set of rolls at a respective preselectable speed, and respective frequency scalar circuit means, driven from the respective pulsatile signal, for operating each of said roll motor means at a respective speed which is an individually preselectable proportion of the speed of the respective spindle, said apparatus further comprising:

a first control circuit means, including a variable oscillator, for operating a plurality of said spindle motor means at a speed corresponding to the operating frequency of said oscillator;

a second control circuit means, including a second variable oscillator, for operating at least one of said spindle motor means at a speed corresponding to the operating frequency of said second oscillator; and respective switching means for connecting each of said spindle motor means to either said first control circuit means or said second control circuit means.

* * * * *